United States Patent [19]

Habermann et al.

[11] Patent Number: 4,775,451

[45] Date of Patent: Oct. 4, 1988

[54] PREPARATION OF WATER-SOLUBLE FOOD-GRADE TRIPHENYLMETHANE COLORS

[75] Inventors: Wolfgang Habermann, Mainz; Odo Mayer, Frankenthal; Peter Hammes, Ruppertsberg; Bernd Landmann, Ludwigshafen, all of Fed. Rep. of Germany

[73] Assignee: BASF Aktiengesellschaft, Rheinland-Pfalz, Fed. Rep. of Germany

[21] Appl. No.: 79,996

[22] Filed: Jul. 31, 1987

[30] Foreign Application Priority Data

Aug. 21, 1986 [DE] Fed. Rep. of Germany ..... 3628354

[51] Int. Cl.[4] ..... C25B 3/02

[52] U.S. Cl. ..... 204/78

[58] Field of Search ..... 204/78, 72

[56] References Cited

U.S. PATENT DOCUMENTS 1,802,640 4/1931 Ewing et al. ..... 204/78

3,758,394 9/1973 Dellian et al. ..... 204/78

4,464,236 8/1984 Noding ..... 204/78

OTHER PUBLICATIONS

Encyclopedia of Chem. Technology, Third Ed. by Kirk-Othmer, vol. 3, pp. 400-403, vol. 6, p. 574.

Journal of Organic Chemistry, vol. 44, pp.761-766.

Chemical Abstracts, vol. 92, 1980, No. 163717c (=Japanese Preliminary Published Application 130,481/1979).

*Primary Examiner*—R. L. Andrews

*Attorney, Agent, or Firm*—Oblon, Fisher, Spivak, McClelland & Maier

[57] ABSTRACT

A process for the preparation of a water soluble food-grade diaminotriphenylmethane colorant containing from 2 to 4 sulfo groups, comprising anodically oxidizing the corresponding leuco compound in an electrolysis cell divided into an anode space and a cathode space in the presence of from 0.01 to 2% by weight, based on the solution being oxidized, of a $C_2$-$C_4$-alkanol, urea, a urea derivative or a mixture thereof, at a potential $\epsilon_h \leqq 1250$ mV and at a temperature $\leqq +40°$ C. The colorants obtained are produced in high yield and are of food quality.

20 Claims, No Drawings

PREPARATION OF WATER-SOLUBLE FOOD-GRADE TRIPHENYLMETHANE COLORS

Japanese Preliminary Published Application No. 130481/1979 describes an electrochemical process for the preparation of triphenylmethane dyes by anodic oxidation of the corresponding leuco triphenylmethane compounds. In this process, the oxidation takes place in an electrolysis cell divided into two by a semipermeable membrane of unglazed porcelain. The oxidation anode used is a net of lead dioxide whose oxygen overvoltage at a current density of $\sim 0.05$ kA/m$^2$ is more than 700 mV. Electrolysis takes place at a pH of from 6 to 7, the current efficiencies and material yields obtained being from 50 to 65%, based on the leuco compounds used. In the oxidation of the leuco compounds of the dye C.I. Acid Blue 9 (C.I. no. 42,090), this process gives an opaque greenish blue dye whose use is restricted.

Products which give pure and brilliant colorations are obtained in high yields according to the prior art by chemical oxidation of the leuco compound of C.I. Acid Blue 9 (C.I. no. 42,090) with alkali metal dichromates in media containing oxalic acid. Separation of the chromium compounds from the color presents difficulties here, so that colors prepared in this manner are not suitable for the food sector.

The preparation of water-soluble diaminotriphenylmethane colors containing from 2 to 4 sulfo groups by anodic oxidation of the leuco compounds in an electrolysis cell divided into two has also been suggested, the leuco compounds being anodically oxidized at a pH of $\leqq 4$ in the presence or absence of oxygen-carrying mineral acid anions, at an oxygen overvoltage of $\leqq 400$ mV. The colors obtained are free from chromium ions but their content of 2-, 3- and 4-sulfobenzaldehyde is greater than the concentration of $\leqq 1.5\%$ by weight in the dry color, this being the concentration approved for food.

It is an object of the present invention to provide an operationally reliable electrochemical process which makes it possible to prepare pure sulfo-containing diaminotriphenylmethane colors, in particular C.I. no. 42,090, in high yield, the said colors meeting the specifications for food colors (C.I. Food Blue 24; C.I. no. 42,090).

We have found that this object is achieved by the process of the invention. The present invention relates to a process for the preparation of water-soluble food-grade diaminotriphenylmethane colors containing from 2 to 4 sulfo groups by anodic oxidation of the leuco compound in an electrolysis cell divided into two, wherein the leuco compound is anodically oxidized in the presence of a small amount of a $C_2$–$C_4$-alkanol, urea, a urea derivative or a mixture of these, at a potential $\epsilon_h < 1250$ mV and at $\leqq +40°$ C.

The novel process gives food-grade sulfo-containing diaminotriphenylmethane colors, in particular C.I. no. 42,090, with a content of $<1.5\%$ by weight of 2-, 3-and 4-sulfobenzaldehyde.

The process according to the invention is carried out in general by introducing the solution of the leuco dye and the added alkanol and/or urea into the anode space of an electrolysis cell which is divided into two and equipped with an anode having a low oxygen overvoltage. The cathode space contains an electrically conductive solution, preferably a mineral acid. Electrolysis is carried out at an oxygen overvoltage of $\leqq 100$ mV, i.e. at a potential which is less than or equal to the theoretical oxygen evolution potential.

Examples of suitable oxidizable leuco compounds are those of the acidic dyes C.I. 42,045, 42,051, 42,052, 42,053, 42,075, 42,080, 42,085, 42,090, 42,095, 42,100, 42,105, 42,120, 42,135, 42,150, 42,155 and 42,165. Preferred leuco compounds are those of the dyes C.I. 42,090, 42,045, 42,051, 42,052, 42,053, 42,080, 42,105, 42,135 and 42,165, in particular the leuco compound of C.I. Acid Blue 9 (C.I. 42,090).

Suitable $C_2$–$C_4$-alkanols are n-butanol, isobutanol, n-propanol, isopropanol and ethanol. Instead of urea, it is also possible to use urea derivatives, such as guanidine, sarcosine, arginine, creatine and creatinine. Ethanol or urea is preferably added to the leuco solution. The leuco dye solution to be electrolyzed contains from 0.01 to 2, preferaby from 0.1 to 0.7, % by weight, based on the solution, of these additives.

The content of sulfate ions in the leuco solution is $<2\%$ by weight, based on the solution. The anode potential $\epsilon_h$ during the electrolytic oxidation is $<1250$ mV, preferably from 750 to 1000 mV. This corresponds to an oxygen overvoltage of from 0 to 100 mV in the anolyte used.

In order to prevent thermally induced formation of sulfobenzaldehyde, the temperature during electrolysis must not exceed $+40°$ C.

Suitable anode materials having low oxygen overvoltages for the leuco dye-containing electrolytes are valve metals, such as titanium, tantalum and niobium, having low microroughness, the metals being doped on the surface with electrically conductive nonstoichiometric mixed oxides of valve metals and metals of the platinum group or platinum metal compounds. Preferred electrodes for this purpose are those which consist of titanium or niobium and whose surface contains mixed oxides of titanium and ruthenium, of tantalum and iridium or of ruthenium and iridium. The surface of the valve metals should not be roughened by blasting with sand, corundum or iron pyrites.

Organic anion and cation exchange membranes have proven useful for separating the anode space and cathode space. Examples of suitable ion exchangers are polymers and copolymers of styrene, styrene and divinylbenzene, styrene and maleic anhydride, acrylates and divinylbenzene, olefins, perfluorinated olefins, and vinyl chloride and acrylonitrile, which carry sulfo groups and/or primary, secondary or tertiary amino groups or quaternary ammonium groups as charge-carrying groups. Cation exchanger membranes are preferred.

Where cation exchanger membranes are used for separating the cathode space and anode space, the catholyte used can be an aqueous mineral acid, a salt solution or an alkali, especially aqueous sulfuric acid or a solution of an alkali metal hydroxide. If an alkali metal hydroxide is used, the alkali corresponding to the alkali metal cation of the leuco dye is used, so that from 25 to 35% by weight of aqueous alkali metal hydroxide can be obtained as a byproduct. Where anion exchanger membranes are used, aqueous alkali metal hydroxides, ammonia or alkali metal or ammonium carbonate or bicarbonate solutions are suitable as catholytes. In order to avoid damaging the membranes, primary, secondary or tertiary amines, for example those containing unsubstituted, hydroxyl-substituted or alkoxy-substituted $C_1$–$C_4$-alkyl radicals on the nitrogen atom, are advantageously added to the alkali metal hydroxides in a concentration of from 0.02 to 10% by weight, based on the alkali metal hydroxide solution.

It is preferable to use cation exchanger membranes and dilute sulfuric acid as the catholyte. The concentration of the sulfuric acid is preferably from 2 to 10% by weight. This combination has the advantage that the dye solutions are further purified to remove foreign metal cations during the oxidation, and damage to the membrane is prevented.

The aqueous solutions of the leuco compounds are used as anolytes. The concentration of the leuco compounds in the anolyte is as a rule from 2 to 40, preferably from 5 to 30, % by weight, based on the solution.

In order to allow diffusion to take place readily, it is necessary to ensure good flow toward the anode in the anode region (turbulent flow and a mean flow rate of $\geqq 0.1$ m/s). The current densities during electrolysis are from 0.05 to 1, preferably from 0.1 to 0.6, kA/m$^2$.

Electrolysis is preferably carried out up to 90% of the theoretically required ampere-hours, based on the leuco compound used, and at a current density of from 0.5 to 0.6 kA/m$^2$, the current density then being reduced to about 0.3 kA/m$^2$.

Since oxygen may form in a side reaction, the effective quantity of electricity should be more than 100%. Quantities of from 101 to 110%, based on the leuco compound used, are preferably chosen.

The anodic oxidation of the leuco compounds is carried out at $\leqq +40°$ C., preferably from $+5°$ to $+30°$ C.

In order to avoid deposits on the anode surfaces and overoxidation of the dye, it has proven advantageous to make the anodes the cathodes for a short time, i.e. from 15 to 30 seconds, when the potential $\epsilon_h$ increases to 1250 mV. When this procedure is used with doped titanium anodes, it is advantageous to use electrodes which are capable of pole reversal and contain intermediate layers of titanium, tantalum or niobium suboxides or carbides, silicides or borides of these metals. Electrodes having titanium suboxide intermediate layers have proven particularly advantageous here.

To avoid coating of the anodes, it has also proven advantageous to cause oxygen to be evolved at the anode in aqueous, 5–10% strength by weight sulfuric acid for a short time (5–10 minutes) prior to electrolysis of the leuco solutions.

The Examples which follow illustrate the process. Parts and percentages are by weight.

EXAMPLE 1

(a) In an electrolysis cell divided into two by a cation exchanger membrane, the anode used is a flat titanium electrode which is doped at the surface with a nonstoichiometric tantalum/iridium mixed oxide and has a titanium suboxide intermediate layer. A Haber-Luggin capillary is fastened to the surface of this anode and connected to a silver/silver chloride reference electrode via a salt bridge. A copper electrode is used as the cathode. Aqueous, 5% strength by weight sulfuric acid is introduced into the cathode space, as the catholyte. The anolyte used is a 20% strength by weight aqueous solution of the leuco compound of C.I. Acid Blue 9 (C.I. no. 42,090), which contains 0.5% by weight of urea (the leuco dye is obtained by condensation of o-sulfobenzaldehyde and N-ethylsulfobenzylaniline). This solution contains ~0.9% of free sulfate. The anolyte is circulated throught the anode space at a mean rate of ~0.5 m/s, and electrolysis is carried out at a current density of 0.6 kA/m$^2$ up to a current efficiency of 90%, based on the leuco compound used ($\epsilon_h$=960 mV).

The current density is then reduced to 0.3 kA/m$^2$, and the electrolysis is ended when the current efficiency reaches 103%.

Electrolysis is carried out at a cell voltage of ~3.5V and at +25° C. The anode potential $\epsilon_h$ at the beginning of electrolysis is about 900 mV. At a theoretical current efficiency of 103%, based on the leuco compound, the potential $\epsilon_h$ increases to about 980 mV. The oxygen overvoltage is 0 mV. The electrolysis is then terminated and the electrolyte worked up.

99.9% pure C.I. Acid Blue 9 (C.I. no. 42,090) is obtained in virtually quantitative yield, based on the leuco dye used, the product having the following data: $\lambda_{max.}$: 631 nm in 0.02M ammonium acetate solution.

The content of 2-, 3- and 4-sulfobenzaldehyde is <0.1%, based on the dry dye.

If titanium anodes doped with titanium/ruthenium mixed oxide or ruthenium/iridium compounds are used similar results are obtained (content of sulfobenzaldehyde <0.1%).

(b) If the electrolysis is carried out under otherwise identical conditions in the absence of urea, a dye which contains 0.85% by weight, based on the dry dye, of 2-, 3- and 4-sulfobenzaldehyde is obtained at a theoretical current efficiency of 103%, based on the leuco compound used.

If electrodes are used whose carriers have been roughened by sanding prior to doping with mixed oxides or iridium/ruthenium compounds, a dye which contains 1.6% by weight, based on dry dye, of 2-, 3- and 4-sulfobenzaldehyde is obtained under otherwise identical conditions.

EXAMPLE 2

The procedure described in Example 1(a) is followed, except that the current efficiency is varied from 60 to 110%, based on the leuco compound, and the content of the formylbenzenesulfonic acids is determined.

For comparison, the process is carried out in the absence of urea, as described in Example 1(b).

| Current efficiency, based on leuco compound | Electrolysis: Content of sulfobenzaldehyde, With urea | Electrolysis: Content of sulfobenzaldehyde, Without urea |
|---|---|---|
| [%] | [%] | [%] |
| 60 | <0.1 | 0.3 |
| 90 | <0.1 | 0.5 |
| 100 | <0.1 | 0.7 |
| 103 | <0.1 | 0.85 |
| 105 | 0.1 | 1.0 |
| 108 | 0.3 | 1.1 |
| 110 | 0.5 | 1.2 |

EXAMPLE 3

The procedure described in Example 1 is followed, except that a flat titanium anode doped with titanium/ruthenium mixed oxide is used. Electrolysis is carried out using the leuco dye solution stated in Example 1(a) and, for comparison, the solution stated in Example 1(b), at various current densities and hence at different anode potentials, up to a current efficiency of 103%. The dependence observed in these experiments for the anode potentials and oxygen overvoltages and contents of 2-, 3- and 4-sulfobenzaldehyde in the product is summarized in Table 1.

EXAMPLE 4

Electrolysis is carried out as described in Example 1(a), but at various temperatures and up to a current efficiency of 103%. The following contents of sulfobenzaldehyde are found as a function of temperature:

| Temperature [°C.] | 2-, 3- and 4-sulfobenzaldehyde [%] |
|---|---|
| 20 | <0.1 |
| 30 | <0.1 |
| 40 | 0.2 |
| 50 | 0.8 |
| 60 | 1.9 |
| 70 | 3.0 |
| 80 | 4.0 |

EXAMPLE 5

Electrolysis is carried out as described in Example 1(a), except that, instead of urea, 0.8% by weight of ethanol is added to the anolyte and a current density of 0.5 kA/m$^2$ is used, electrolysis being continued to a current efficiency of 90%. The current density is then reduced to 0.3 kA/m$^2$and electrolysis is ended when a current efficiency of 105% is reached.

99.8% pure Acid Blue 9 (C.I. no. 42,090) is obtained in virtually quantitative yield, based on the leuco dye used, the product having the following data: $\lambda_{max.}$: 631 nm in 0.02M ammonium acetate solution content of 2-, 3- and 4-sulfobenzaldehyde: 0.2%.

EXAMPLES 6 TO 9

The oxidation is carried out as stated in Example 5, except that the alcohols shown in the Table are used. The corresponding dyes are obtained in high yields and good purity and with good color properties. The contents of 2-, 3- and 4-sulfobenzaldehyde are stated in the last column.

| Example | Alcohol | 2-, 3- and 4-sulfobenzaldehyde |
|---|---|---|
| 6 | n-propanol | <0.1 |
| 7 | isopropanol | <0.1 |
| 8 | n-butanol | 0.2 |
| 9 | isobutanol | 0.2 |

TABLE 1

| | In the presence of urea | | | Without urea | | |
|---|---|---|---|---|---|---|
| Current density [kAm$^{-2}$] | Anode potential [mV] | $E_o$ [mV] | Content of sulfobenzaldehyde [%] | Anode potential [mV] | $E_o$ [mV] | Content of sulfobenzaldehyde [%] |
| 0.2 | 780 | 0 | <0.1 | 1100 | 0 | 0.6 |
| 0.3 | 850 | 0 | 0.2 | 1200 | 30 | 0.8 |
| 0.8 | 1050 | 0 | 0.6 | 1300 | 130 | 1.9 |
| 1.0 | 1090 | 0 | 0.8 | 1400 | 230 | 3.6 |

$E_o$ = oxygen overvoltage at the anode

We claim:

1. A process for the preparation of a water soluble food-grade diaminotriphenylmethane colorant containing from 2 to 4 sulfo groups, comprising:

anodically oxidizing the corresponding leuco compound in an electrolysis cell divided into an anode space and a cathode space in the presence of from 0.01 to 2% by weight, based on the solution being oxidized, of a $C_2$–$C_4$-alkanol, urea, a urea derivative or a mixture thereof, at a potential $\epsilon_h \leqq 1250$ mV and at a temperature $\leqq +40°$ C.

2. The process as claimed in claim 1, wherein the anodic oxidation is carried out at potentials $\epsilon_h$ of from 750 to 1000 mV.

3. The process as claimed in claim 1, wherein a leuco compound of the dye C.I. 42,090, 42,045, 42,051, 42,052, 42,053, 42,080, 42,105, 42,135 or 42,165 is oxidized.

4. The process as claimed in claim 2, wherein a leuco compound of the dye C.I. 42,090, 42,045, 42,051, 42,052, 42,053, 42,080, 42,105, 42,135 or 42,165 is oxidized.

5. The process as claimed in claim 1, wherein the leuco compound of C.I. no. 42,090 is oxidized.

6. The process as claimed in claim 2, wherein the leuco compound of C.I. no. 42,090 is oxidized.

7. The process as claimed in claim 1, wherein the solution of the leuco dye contains from 0.1 to 0.7% by weight, based on the solution, of an alkanol, urea or a mixture of these.

8. The process as claimed in claim 2, wherein the solution of the leuco dye contains from 0.1 to 0.7% by weight, based on the solution, of an alkanol, urea or a mixture of these.

9. The process as claimed in claim 4, wherein the solution of the leuco dye contains from 0.1 to 0.7% by weight, based on the solution, of an alkanol, urea or a mixture of these.

10. The process as claimed in claim 6, wherein the solution of the leuco dye contains from 0.1 to 0.7% by weight, based on the solution, of an alkanol, urea or a mixture of these.

11. The process as claimed in claim 3, wherein the leuco solution contains $\leqq$2% by weight, based on the solution, of sulfate.

12. The process as claimed in claim 4, wherein the leuco solution contains $\leqq$2% by weight, based on the solution, of sulfate.

13. The process as claimed in claim 6, wherein the leuco solution contains $\leqq$2% by weight, based on the solution, of sulfate.

14. The process as claimed in claim 1, wherein titanium or niobium having low microroughness is used as the anode, which has, on the surface, electrically conductive oxide compounds of titanium and ruthenium, of tantalum and iridium or of ruthenium and iridium.

15. The process as claimed in claim 2, wherein titanium or niobium having low microroughness is used as the anode, which has, on the surface, electrically conductive oxide compounds of titanium and ruthenium, of tantalum and iridium or of ruthenium and iridium.

16. The process as claimed in claim 12, wherein titanium or niobium having low microroughness is used as the anode, which has, on the surface, electrically conductive oxide compounds of titanium and ruthenium, of tantalum and iridium or of ruthenium and iridium.

17. The process as claimed in claim 1, wherein the anode space and cathode space are separated by a cation exchanger membrane.

18. The process as claimed in claim 15, wherein the anode space and cathode space are separated by a cation exchanger membrane.

19. The process as claimed in claim 16, wherein the anode space and cathode space are separated by a cation exchanger membrane.

20. A process for the preparation of food-grade C.I. Acid Blue 9 (C.I. No. 42,090; Food Blue 24), comprising:

anodically oxidizing the corresponding leuco compound in an electrolysis cell divided into an anode space and a cathode space in the presence of from 0.01 to 0.7% by weight, based on the solution being oxidized, of a $C_2$–$C_4$-alkanol or urea at a potential $\epsilon_h$ of from 750 to 1000 mV, the solution of the leuco compound containing not more than 2% by weight, based on the solution, of sulfate ion, and the anode within the anode space consisting of titanium or niobium which has low microroughness and contains, on its surface, electrically conductive oxide compounds of titanium and ruthenium, tantalum and iridium or ruthenium and iridium.

* * * * *

UNITED STATES PATENT AND TRADEMARK OFFICE

CERTIFICATE OF CORRECTION

PATENT NO. : 4,775,451

DATED : Oct. 4, 1988

INVENTOR(S) : Wolfgang HABERMANN et al.

It is certified that error appears in the above-identified patent and that said Letters Patent is hereby corrected as shown below:

On the Title Page, Item [75]:

The second inventor's name has been misspelled; please correct as follows:

-- Udo Mayer --

Signed and Sealed this

Twenty-eighth Day of February, 1989

*Attest:*

DONALD J. QUIGG

*Attesting Officer*

*Commissioner of Patents and Trademarks*